US011791593B2

(12) United States Patent
Yokota et al.

(10) Patent No.: US 11,791,593 B2
(45) Date of Patent: Oct. 17, 2023

(54) CONNECTOR-EQUIPPED MULTICORE CABLE

(71) Applicant: SUMITOMO ELECTRIC INDUSTRIES, LTD., Osaka (JP)

(72) Inventors: Naoshige Yokota, Tochigi (JP); Masaki Suzuki, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 97 days.

(21) Appl. No.: 17/597,056

(22) PCT Filed: Jun. 2, 2020

(86) PCT No.: PCT/JP2020/021814

§ 371 (c)(1),
(2) Date: Dec. 23, 2021

(87) PCT Pub. No.: WO2021/245801

PCT Pub. Date: Dec. 9, 2021

(65) Prior Publication Data

US 2022/0320805 A1 Oct. 6, 2022

(51) Int. Cl.
*H01R 13/6591* (2011.01)
*H01R 13/6581* (2011.01)
(Continued)

(52) U.S. Cl.
CPC ..... *H01R 13/65912* (2020.08); *H01R 9/0515* (2013.01); *H01R 13/648* (2013.01); *H01R 13/6581* (2013.01); *H01R 13/6591* (2013.01); *H01R 13/6592* (2013.01); *H01R 13/65914* (2020.08); *H01R 9/05* (2013.01); *H01R 9/0512* (2013.01); *H01R 13/6593* (2013.01); *H01R 13/6594* (2013.01); *H01R 13/6595* (2013.01);
(Continued)

(58) Field of Classification Search
CPC ..... H01R 13/65912; H01R 9/0515; H01R 13/648; H01R 13/6581; H01R 13/6591; H01R 13/65914; H01R 13/6592; H01R 9/05; H01R 9/0512; H01R 13/65918; H01R 13/6593; H01R 13/6594; H01R 13/6595; H01R 24/60; H01R 31/06
See application file for complete search history.

(56) References Cited

U.S. PATENT DOCUMENTS

| | | | | |
|---|---|---|---|---|
| 5,518,421 | A | 5/1996 | Davis | |
| 2018/0261956 | A1 | 9/2018 | Yamaguchi et al. | |
| 2019/0173237 | A1 * | 6/2019 | Oosaka | H01R 13/26 |

FOREIGN PATENT DOCUMENTS

| | | | | |
|---|---|---|---|---|
| CN | 110137726 A | * | 8/2019 | H01R 13/02 |
| JP | H06-243933 | | 9/1994 | |

(Continued)

*Primary Examiner* — Abdullah A Riyami
*Assistant Examiner* — Justin M Kratt
(74) *Attorney, Agent, or Firm* — IPUSA, PLLC

(57) ABSTRACT

A connector-equipped multicore cable includes a connector including a first end portion and a second end portion and a multicore cable including a plurality of coaxial electrical wires and connected to the first end portion. The connector includes, at the second end portion, a cover that is made of a metal and that covers a connector terminal. The plurality of coaxial electrical wires each include a first shield layer. The first shield layer and the cover are electrically connected to each other.

8 Claims, 13 Drawing Sheets

(51) Int. Cl.

| | |
|---|---|
| ***H01R 13/6592*** | (2011.01) |
| ***H01R 9/05*** | (2006.01) |
| ***H01R 13/648*** | (2006.01) |
| *H01R 24/60* | (2011.01) |
| *H01R 13/6594* | (2011.01) |
| *H01R 13/6593* | (2011.01) |
| *H01R 13/6595* | (2011.01) |
| *H01R 31/06* | (2006.01) |

(52) U.S. Cl.
CPC ..... *H01R 13/65918* (2020.08); *H01R 24/60* (2013.01); *H01R 31/06* (2013.01)

(56) References Cited

FOREIGN PATENT DOCUMENTS

| | | |
|---|---|---|
| JP | 2017-069152 | 4/2017 |
| JP | 2017-135030 | 8/2017 |
| JP | 2018-152244 | 9/2018 |
| JP | 2019-102350 | 6/2019 |

* cited by examiner

CONNECTOR-EQUIPPED MULTICORE CABLE

BACKGROUND OF THE INVENTION

Technical Field

The present disclosure relates to a connector-equipped multicore cable.

Background Art

Patent Document 1 discloses, as a connector-equipped multicore cable used for transmission between electronic devices, a connector-equipped multicore cable that can be connected to an electronic device regardless of the vertical orientation of the connector.

PRIOR ART DOCUMENT

Patent Literature

[Patent Document 1] Japanese Laid-Open Patent Publication No. 2017-69152

BRIEF SUMMARY OF THE INVENTION

A connector-equipped multicore cable of the present disclosure includes a connector including a first end portion and a second end portion, and a multicore cable including a plurality of coaxial electrical wires and connected to the first end portion. The connector includes, at the second end portion, a cover that is made of metal and that covers a connector terminal. The plurality of coaxial electrical wires each include a first shield layer. The first shield layer and the cover are electrically connected to each other.

DETAILED DESCRIPTION OF THE INVENTION

Figure 1:
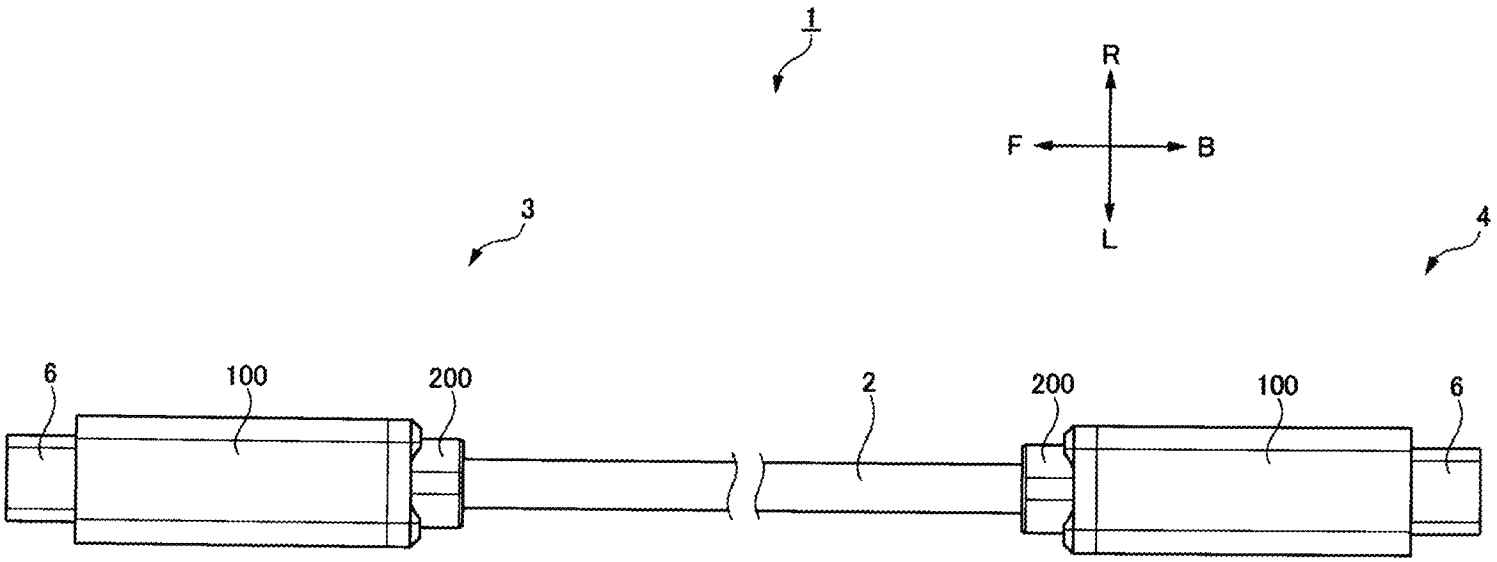
FIG. 1 is a top view illustrating a connector-equipped multicore cable according to an embodiment.

Problems to be Solved by Present Disclosure

According to the technique described in Patent Document 1, although the intended object is achieved, there is a possibility that noise increases when the frequency of a signal becomes higher.

Advantageous Effects of Present Disclosure

According to the present disclosure, noise can be further reduced.

In the following, an embodiment will be described.

Description of Embodiments of Present Disclosure

First, embodiments of the present disclosure will be listed and described. In the following description, the same or corresponding elements are denoted by the same reference numerals, and the same description thereof will not be repeated.

<1> A connector-equipped multicore cable according to one aspect of the present disclosure includes a connector including a first end portion and a second end portion, and a multicore cable including a plurality of coaxial electrical wires and connected to the first end portion. The connector includes, at the second end portion, a cover that is made of metal and that covers a connector terminal. The plurality of coaxial electrical wires each include a first shield layer. The first shield layer and the cover are electrically connected to each other.

According to the connector-equipped multicore cable in one aspect of the present disclosure, a first shield layer of the coaxial electrical wire and the cover that is made of the metal are electrically connected. Therefore, the ground potential can be supplied to the first shield layer through the cover that is made of the metal. Therefore, noise of a signal transmitted through the coaxial electrical wire can be reduced.

<2> In the connector-equipped multicore cable according to <1>, the connector may include an outer case into which one end of the multicore cable is inserted, and a portion of the cover may be exposed from the outer case. In this case, an inner portion of the outer case of the multicore cable can be insulated from the outside while the cover that is made of metal can be connected to the electronic device.

<3> In the connector-equipped multicore cable according to <1> or <2>, the connector may include a substrate having a first surface to which a first coaxial electrical wire included in the plurality of coaxial electrical wires is connected, and a first metal plate that covers the first surface to which the first coaxial electrical wire is connected and that is connected to the cover and the first shield layer of the first coaxial electrical wire. In this case, the connector can be easily assembled.

<4> In the connector-equipped multicore cable according to <3>, the multicore cable may include a second shield layer that covers the plurality of coaxial electrical wires, and the first metal plate may be connected to the second shield layer. In this case, the first shield layer of the coaxial electrical wires can be electrically connected to the second shield layer of the multicore cable.

<5> In the connector-equipped multicore cable according to <3> or <4>, the first metal plate may include a first body portion, and a first elastic member extending from the first body portion and connected to the first shield layer of the first coaxial electrical wire. In this case, it is easy to electrically connect the first metal plate and the first shield layer.

<6> In the connector-equipped multicore cable according to <5>, the first elastic member may press the first coaxial electrical wire against the substrate. In this case, the first coaxial electrical wire is less likely to be displaced on the substrate.

<7> In the connector-equipped multicore cable according to <5> or <6>, the first elastic member may be a first plate spring. In this case, it is easy to manufacture the first metal plate.

<8> In the connector-equipped multicore cable according to any one of <3> to <7>, the substrate may have a second surface to which a second coaxial electrical wire included in the plurality of coaxial electrical wires is and the second surface is opposite to the first surface. The connector may include a second metal plate that covers the second surface to which the second coaxial electrical wire is connected and that is connected to the cover and the first shield layer of the second coaxial electrical wire. The second metal plate may include a second body portion and a second elastic member extending from the second body portion and connected to the first shield layer of the second coaxial electrical wire. In this case, the connector can be easily assembled.

<9> In the connector-equipped multicore cable according to <8>, the second elastic member may press the second coaxial electrical wire against the substrate. In this case, the second coaxial electrical wire is less likely to be displaced on the substrate.

<10> In [8] or [9], the second elastic member may be a second plate spring. In this case, it is easy to manufacture the second metal plate.

<11> In the connector-equipped multicore cable according to any one of <8> to <10>, the first metal plate and the second metal plate may be coupled to each other. In this case, noise of a signal transmitted through the coaxial electrical wire can be further reduced.

<12> A connector-equipped multicore cable according to another aspect of the present disclosure includes a connector including a first end portion and a second end portion, and a multicore cable including a plurality of coaxial electrical wires and connected to the first end portion. The connector includes, at the second end portion, a cover that is made of metal and that covers a connector terminal. The plurality of coaxial electrical wires each include a first shield layer, and the first shield layer and the cover are electrically connected to each other. The connector includes an outer case into which one end of the multicore cable is inserted, a substrate having a first surface to which a first coaxial electrical wire included in the plurality of coaxial electrical wires is connected, and a second surface to which a second coaxial electrical wire included in the plurality of coaxial electrical wires is connected, a first metal plate that covers the first surface to which the first coaxial electrical wire is connected and that is connected to the cover and the first shield layer of the first coaxial electrical wire, and a second metal plate that covers the second surface to which the second coaxial electrical wire is connected and that is connected to the cover and the first shield layer of the second coaxial electrical wire. A portion of the cover is exposed from the outer case. The first metal plate includes a first body portion and a first plate spring extending from the first body portion and connected to the first shield layer of the first coaxial electrical wire. The second metal plate includes a second body portion and a second plate spring extending from the second body portion and connected to the first shield layer of the second coaxial electrical wire. The first metal plate and the second metal plate are coupled to each other.

According to the connector-equipped multicore cable in another aspect of the present disclosure, a ground potential can be supplied to the first shield layer through the cover that is made of metal, and noise of a signal transmitted through the coaxial electrical wire can be reduced.

Details of Embodiments of Present Disclosure

In the following, an embodiment of the present disclosure will be described in detail. However, the present disclosure is not limited to the following embodiment. It should be noted that in the specification and the drawings of the present application, the same reference numerals may be assigned to components having substantially the same function/configuration so that repetitive descriptions may be omitted.

<Configuration of Multicore Cable>

Figure 2:
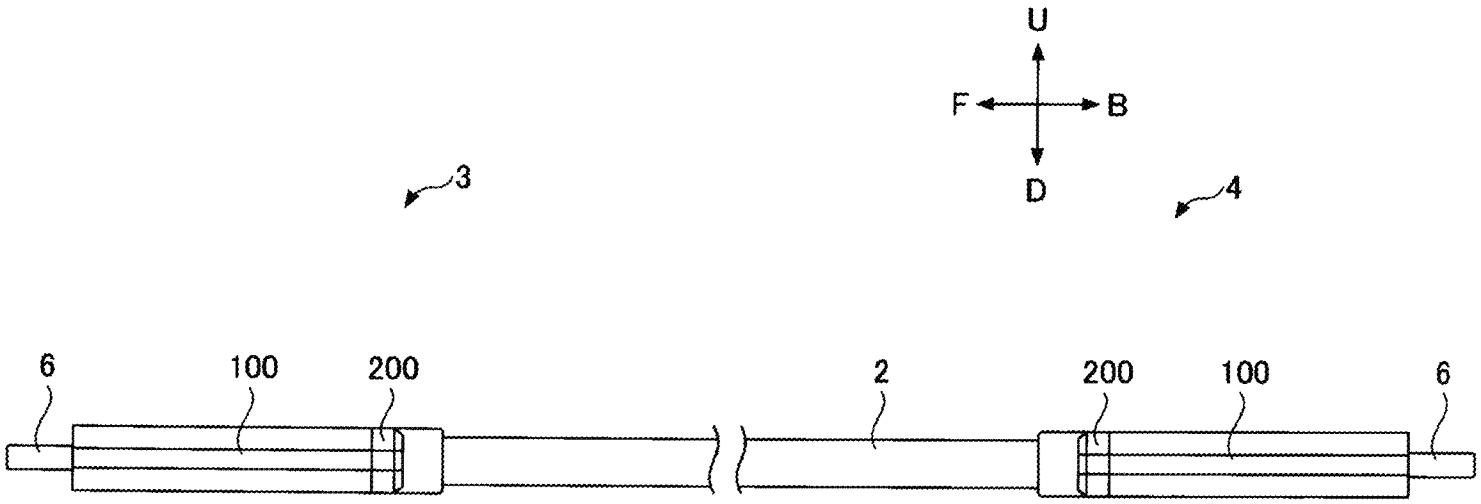
FIG. 2 is a side view illustrating a connector-equipped multicore cable according to an embodiment.

First, a configuration of a connector-equipped multicore cable according to the embodiment is described. FIG. 1 is a top view illustrating the connector-equipped multicore cable according to the embodiment. FIG. 2 is a side view illustrating the connector-equipped multicore cable according to the embodiment.

A connector-equipped multicore cable 1 according to the embodiment of the present disclosure may be used, for example, as a cable for connecting electronic devices (not shown) to each other. It should be noted that in the diagrams such as FIG. 1, U, D, F, B, R, and L indicate directions in connector-equipped multicore cable 1, and U indicates "upward" (or upper), D indicates "downward" (or lower), F indicates "front", B indicates "back" (or behind), R indicates "right", and L indicates "left". FIG. 2 is a side view viewed from the left L.

As illustrated in FIGS. 1 and 2, connector-equipped multicore cable 1 includes a multicore cable 2, a first connector 3, and a second connector 4. First connector 3 is attached to the end portion of the front side (F side) of multicore cable 2. Second connector 4 is attached to the end portion of the rear side (B side) of multicore cable 2.

<Configuration of Multicore Cable>

Figure 3:
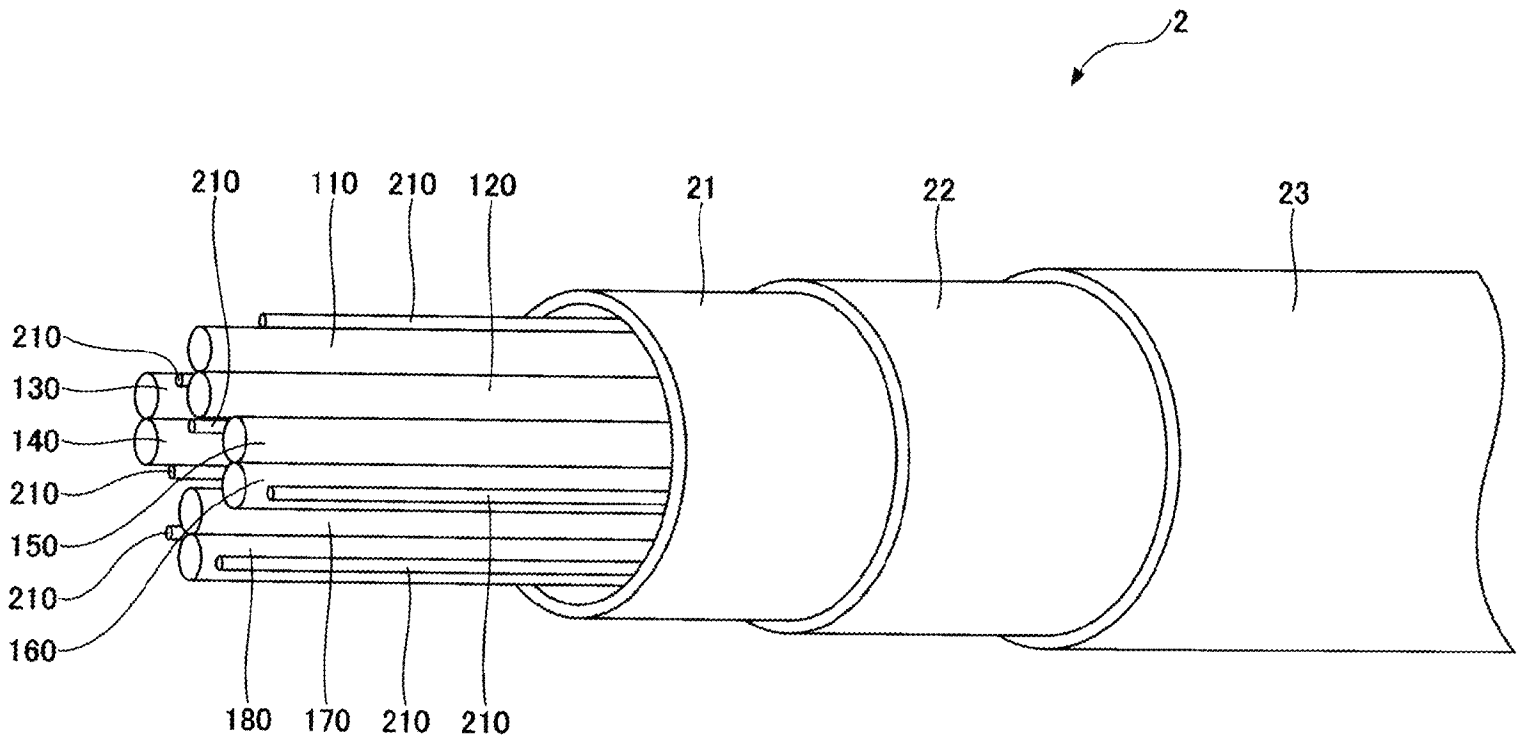
FIG. 3 is a diagram illustrating an outline of a configuration of a multicore cable.

Next, a configuration of the multicore cable is described. FIG. 3 is a drawing schematically illustrating the configuration of the multicore cable.

As illustrated in FIG. 3, multicore cable 2 includes coaxial electrical wires 110, 120, 130, 140, 150, 160, 170, and 180 that are high-speed signal lines. A high-speed first differential signal is transmitted through coaxial electrical wires 110 and 120. A high-speed second differential signal is transmitted through coaxial electrical wires 130 and 140. A high-speed third differential signal is transmitted through coaxial electrical wires 150 and 160. A fourth differential signal of high speed is transmitted through coaxial electrical wires 170 and 180. Multicore cable 2 further includes a plurality of (for example, seven) electrical wires 210. Multicore cable 2 further includes an insulating layer 21 provided around the coaxial electrical wires and the electrical wires, a shield layer 22 provided on the periphery of insulating layer 21, and an insulating outer sheath 23 provided on the periphery of shield layer 22. Shield layer 22 is, for example, braided. Shield layer 22 is an example of a second shield layer.

<Configuration of Connector>

Figure 4:
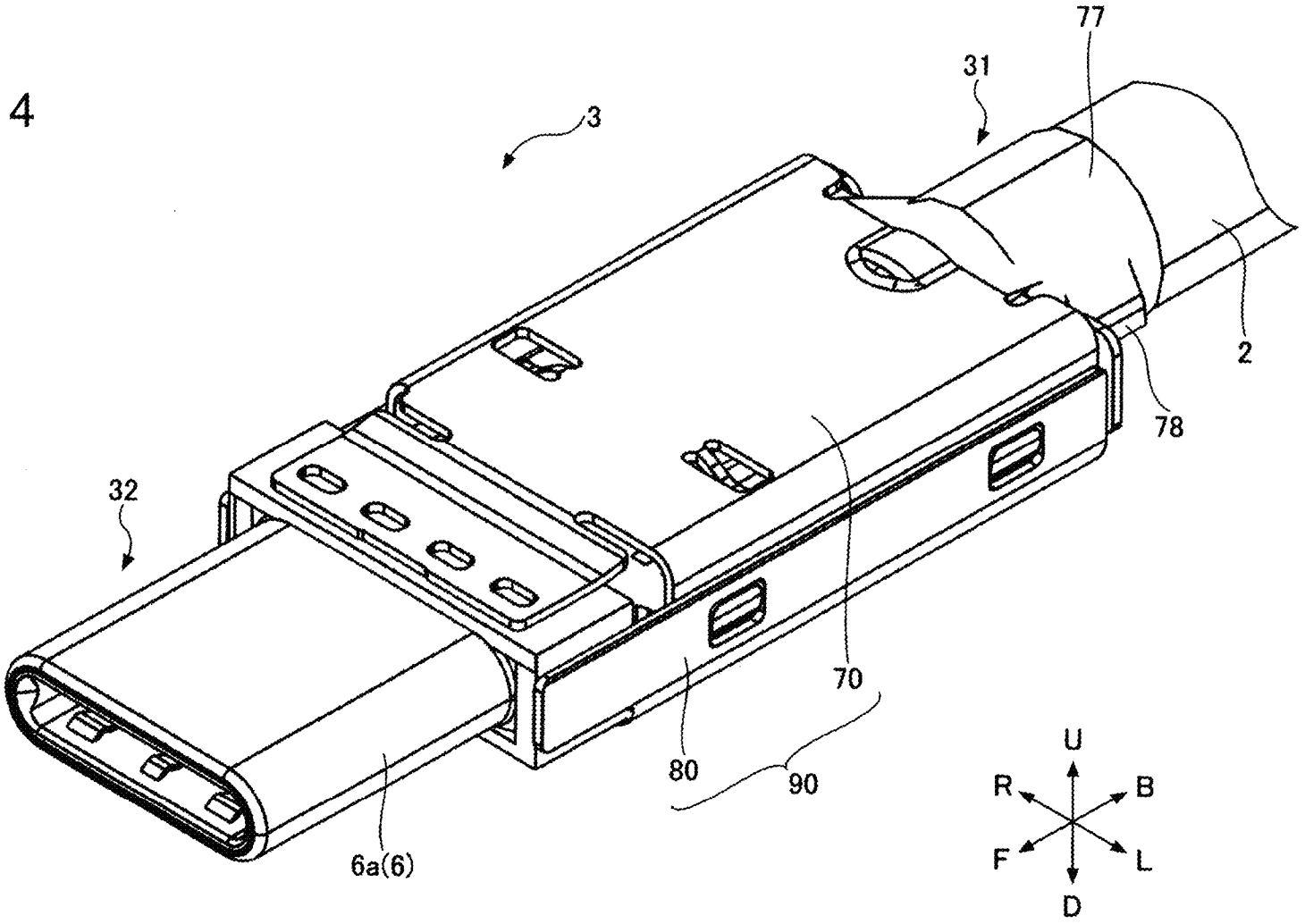
FIG. 4 is a perspective view illustrating a configuration of a connector.

Next, the configuration of the connector is described. Each of first connector 3 and second connector 4 has a boot 100 and a strain relief 200 as housings. In first connector 3, strain relief 200 is provided on the back side (B side) of boot 100, and in second connector 4, strain relief 200 is provided on the front side (F side) of boot 100. Second connector 4 has the same configuration as that of first connector 3 except for the orientation based on multicore cable 2. Therefore, hereinafter, the configuration of first connector 3 is described in detail, and the description of the configuration of second connector 4 is omitted. FIG. 4 is a perspective view illustrating the configuration of the connector.

In first connector 3, a through hole (not shown) is formed in strain relief 200, and one end of multicore cable 2 is inserted into boot 100 through the through hole. That is, multicore cable 2 is connected to a first end portion 31 on the back side (B side) of first connector 3. As illustrated in FIG. 4, first connector 3 has a metal connector plug 6 connected to a receptacle (not shown) of the electronic device at a second end portion 32 on the front side (F side). Connector plug 6 has a substantially elongated cylindrical metal shell 6*a* as a housing. A plurality of (for example, 24) connector pins 6*b* (see FIGS. 11 and 12) to be connected to the receptacle of the electronic device are housed in metal shell 6*a*. Plurality of connector pins 6*b* are held by a pin holding plate (not shown) disposed in metal shell 6*a*. Plurality of connector pins 6*b* are held by the pin holding plate such that plurality of connector pins 6*b* are connectable to the receptacle of the electronic device even if the right-left orientation or the upward-downward orientation of first connector 3 and second connector 4 are reversed. As described above, first connector 3 includes first end portion 31 on the back side (B side) and second end portion 32 on the front side (F side), and multicore cable 2 is connected to first end portion 31. First connector 3 has metal shell 6*a* at second end portion 32. A portion of metal shell 6*a* is exposed from boot 100. Metal shell 6*a* is an example of a cover that is made of metal. Connector pin 6*b* is an example of a connector terminal. Boot 100 is an example of an outer case.

Figure 5:
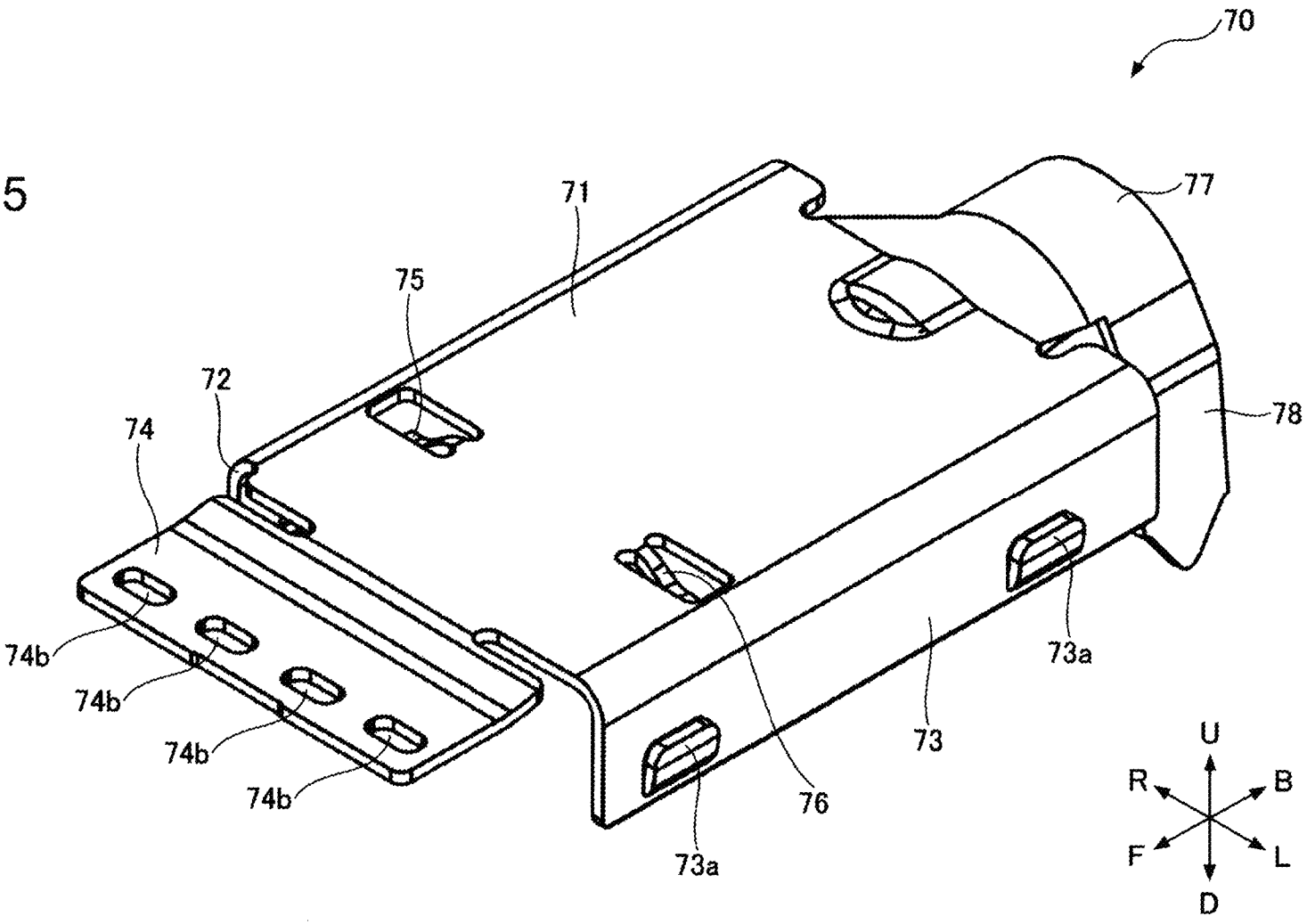
FIG. 5 is a perspective view illustrating an upper frame.
Figure 6:
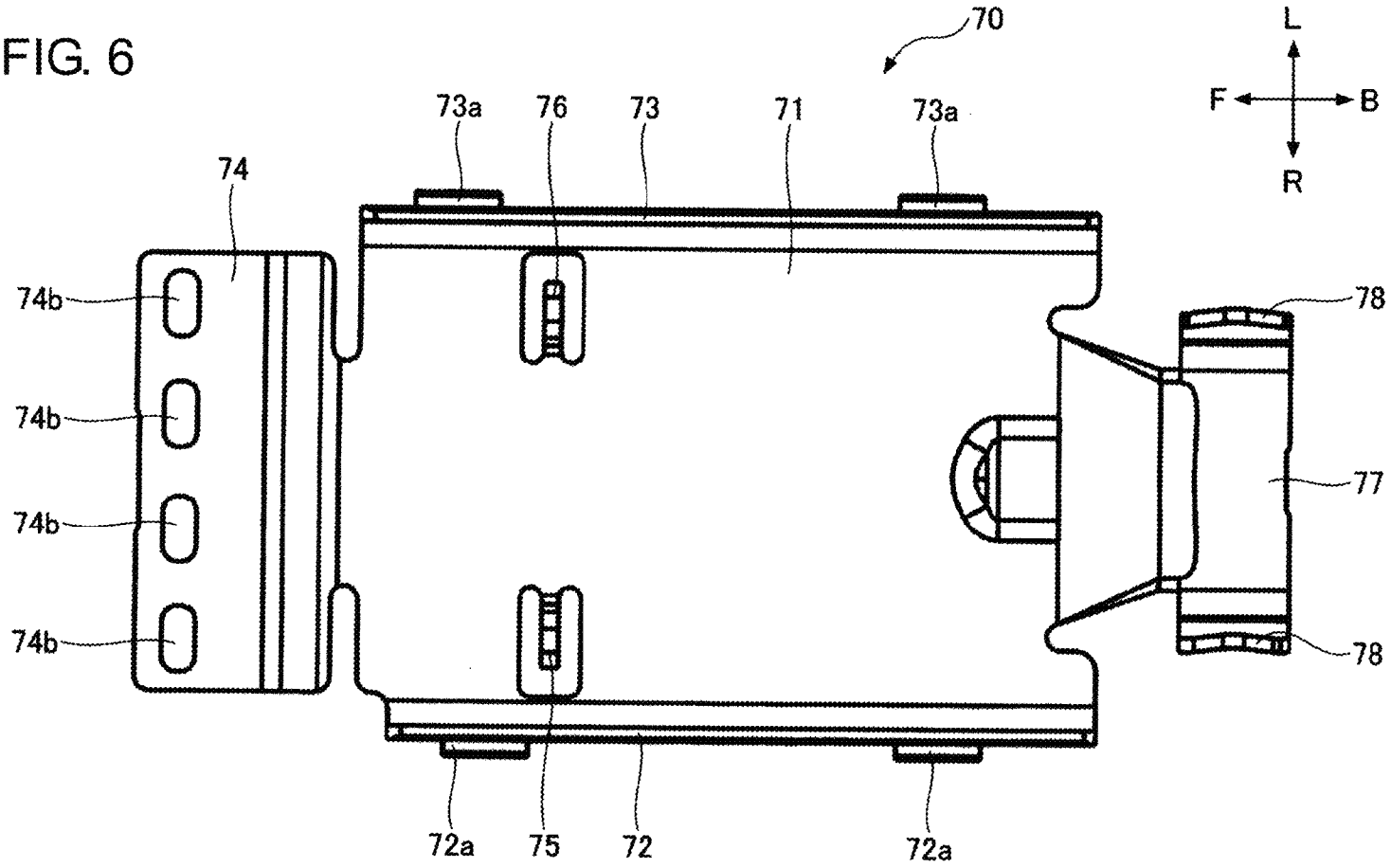
FIG. 6 is a bottom view illustrating an upper frame.
Figure 7:
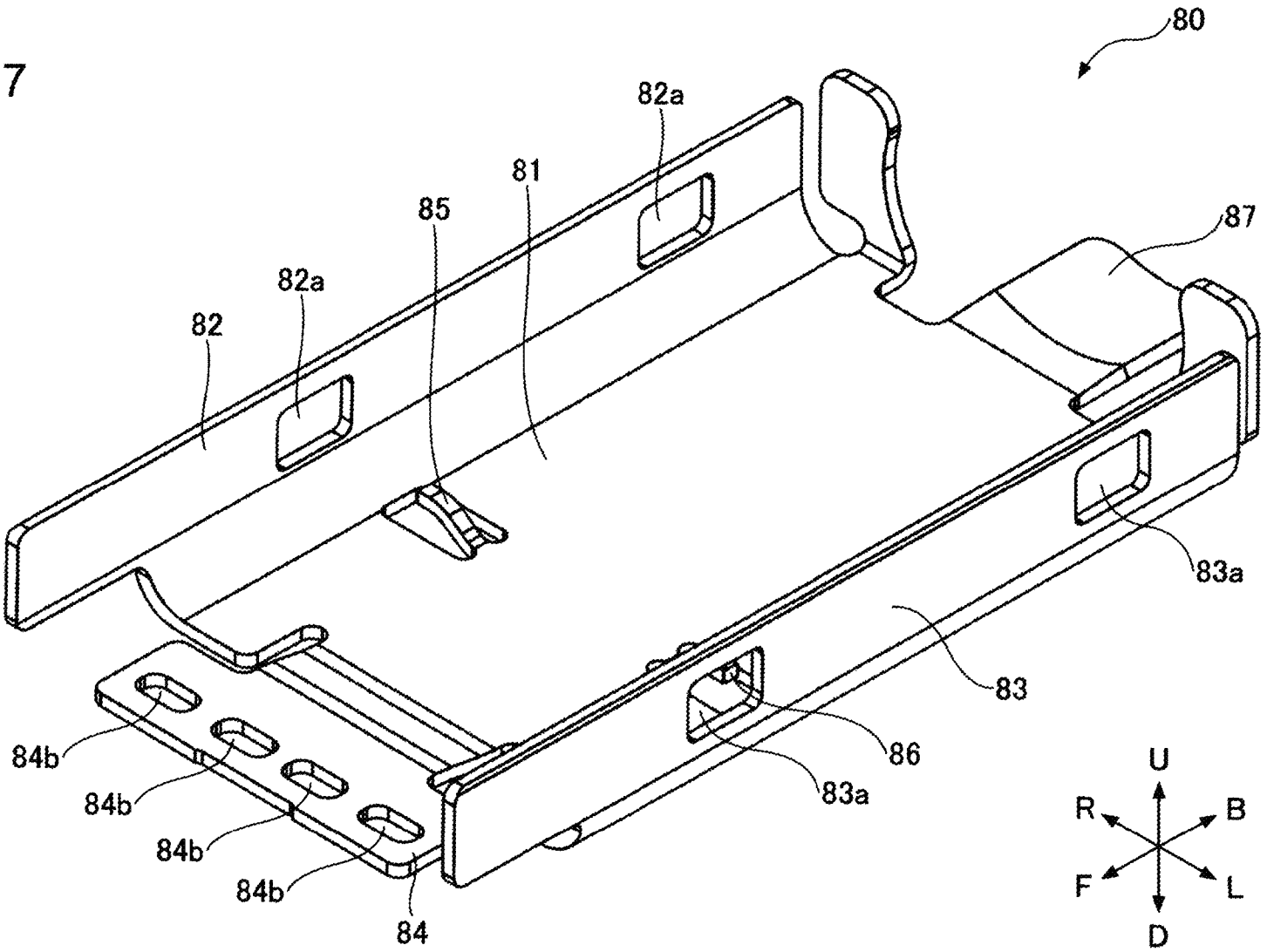
FIG. 7 is a perspective view illustrating a lower frame.
Figure 8:
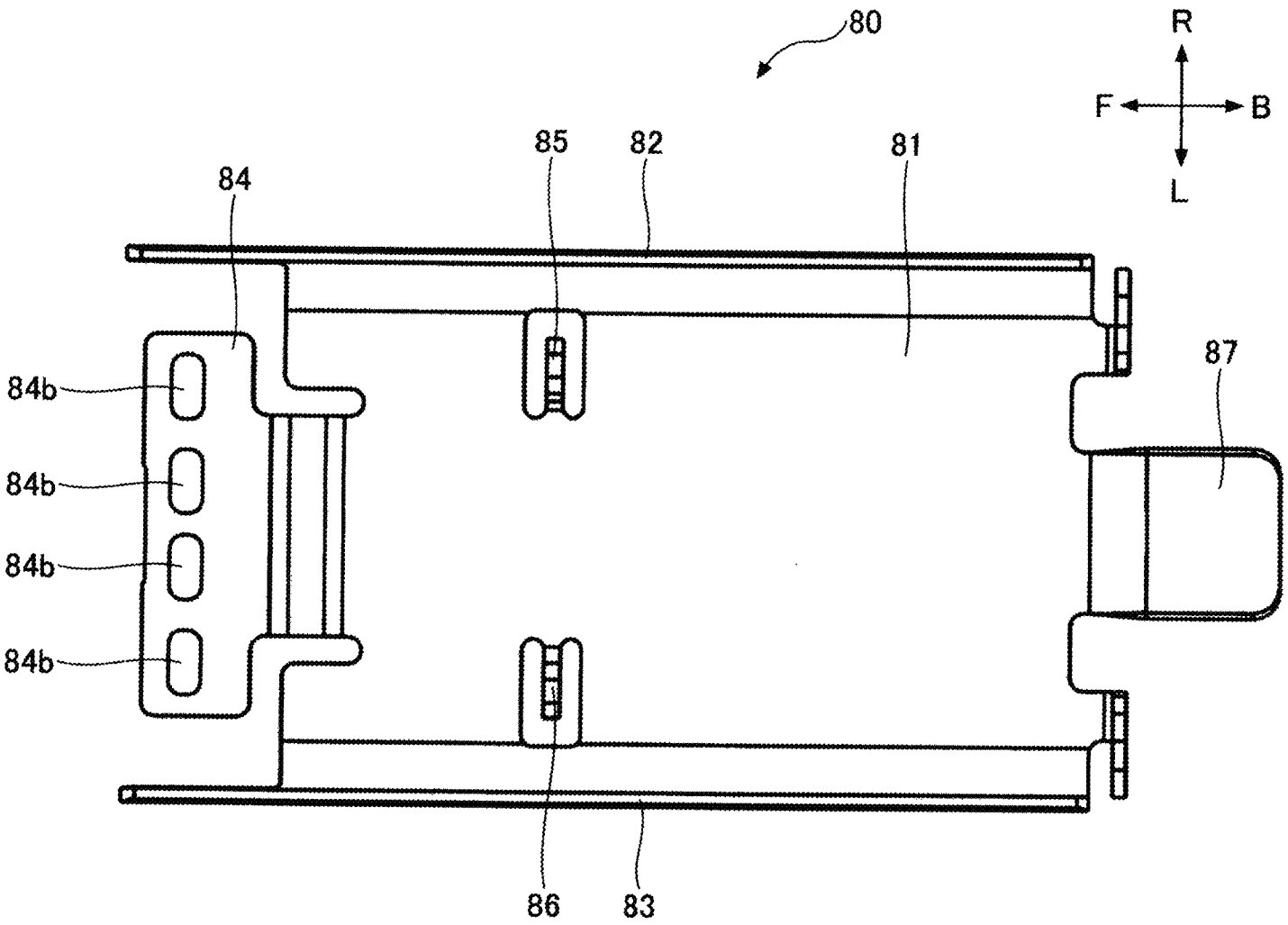
FIG. 8 is a top view illustrating a lower frame.

First connector 3 has a frame 90 made of metal inside boot 100, and frame 90 is connected to metal shell 6*a*. Frame 90 includes an upper frame 70 made of metal and a lower frame 80 made of metal. Upper frame 70 and lower frame 80 are connected to each other. Upper frame 70 is provided in the upward U direction with respect to lower frame 80. Upper frame 70 and lower frame 80 are both formed by punching and bending metal plates, for example. For example, the thicknesses of the metal plates used in upper frame 70 and lower frame 80 are between 0.1 mm and 0.4 mm. FIG. 5 is a perspective view illustrating the upper frame. FIG. 6 is a bottom view illustrating the upper frame. FIG. 7 is a perspective view illustrating the lower frame. FIG. 8 is a top view illustrating the lower frame.

As illustrated in FIGS. 5 and 6, upper frame 70 includes an upper plate 71, a side plate 72, a side plate 73, a coupling portion 74, plate springs 75 and 76, a fixing portion 77, and claw portions 78. Upper plate 71 has a rectangular planar shape in the top view, side plate 72 extends in the downward D direction from an end portion of the right side (R side) of upper plate 71, and side plate 73 extends in the downward D direction from an end portion of the left side (L side) of upper plate 71. Plate springs 75 and 76 extend in the downward D direction from upper plate 71. Plate spring 76 is provided on the left side (L side) of plate spring 75. A plurality of (for example, two) protrusions 72*a* are formed side by side in the FB direction on the side surface on the right side (R side) of side plate 72, and a plurality of (for example, two) protrusions 73*a* are formed side by side in the FB direction on the side surface on the left side (L side) of side plate 73. Coupling portion 74 is connected to the front side (F side) of upper plate 71. Coupling portion 74 has a plate shape, and a plurality of (for example, four) openings 74*b* are formed in coupling portion 74. Coupling portion 74 is soldered to metal shell 6*a* through opening 74*b*. Fixing portion 77 is connected to the back side (B side) of upper plate 71, and has a plate shape curved so as to follow the peripheral surface of multicore cable 2. Fixing portion 77 is provided with two claw portions 78. Two claw portions 78 are provided so as to sandwich fixing portion 77 therebetween in the RL direction. The end portion of the front side (F side) of multicore cable 2 is inside boot 100 of first connector 3, outer sheath 23 of multicore cable 2 is peeled off inside boot 100, and claw portions 78 are crimped to shield layer 22 in the portion where outer sheath 23 is peeled off. That is, fixing portion 77 and two claw portions 78 are in contact with and electrically connected to shield layer 22. Upper frame 70 is an example of a first metal plate, upper plate 71 is an example of a first body portion, and plate springs 75 and 76 are examples of a first elastic member and a first plate spring.

As illustrated in FIGS. 7 and 8, lower frame 80 includes a lower plate 81, a side plate 82, a side plate 83, a coupling portion 84, plate springs 85 and 86, and a fixing portion 87. Lower plate 81 has a rectangular planar shape in the top view, side plate 82 extends in upward U direction from an end portion on the right side (R side) of lower plate 81, and side plate 83 extends in upward U direction from an end portion on the left side (L side) of lower plate 81. Plate springs 85 and 86 extend in upward U direction from lower plate 81. Plate spring 86 is provided on the left side (L side) of plate spring 85. A plurality of (for example, two) openings 82*a* are formed side by side in the FB direction on side plate 82, and a plurality of (for example, two) openings 83*a* are formed side by side in the FB direction on side plate 83. Upper frame 70 and lower frame 80 are coupled to each other by fitting protrusions 72*a* into openings 82*a*, and fitting protrusions 73*a* into openings 83*a*. Coupling portion 84 is connected to the front side (F side) of lower plate 81. Coupling portion 84 has a plate shape, and a plurality of (for example, four) openings 84*b* are formed in coupling portion 84. Coupling portion 84 is soldered to metal shell 6*a* through opening 84*b*. Fixing portion 87 is connected to the rear side (B side) of lower plate 81, and has a plate shape curved so as to follow the peripheral surface of multicore cable 2. Fixing portion 87 is in contact with and electrically connected to shield layer 22. Lower frame 80 is an example of a second metal plate, lower plate 81 is an example of a second body portion, and plate springs 85 and 86 are examples of a second elastic member and a second plate spring.

Figure 9:
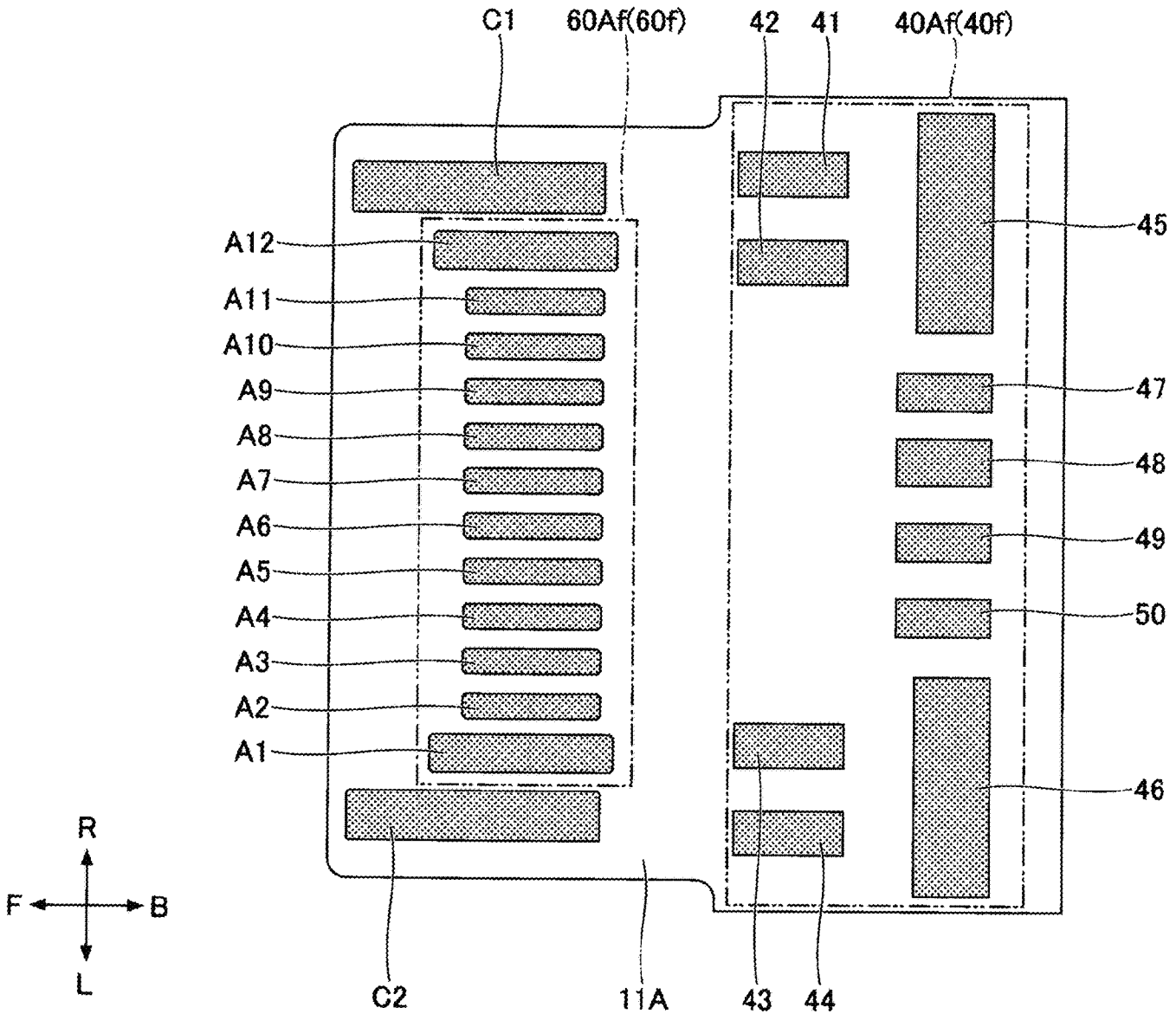
FIG. 9 is a top view illustrating the first substrate.
Figure 10:
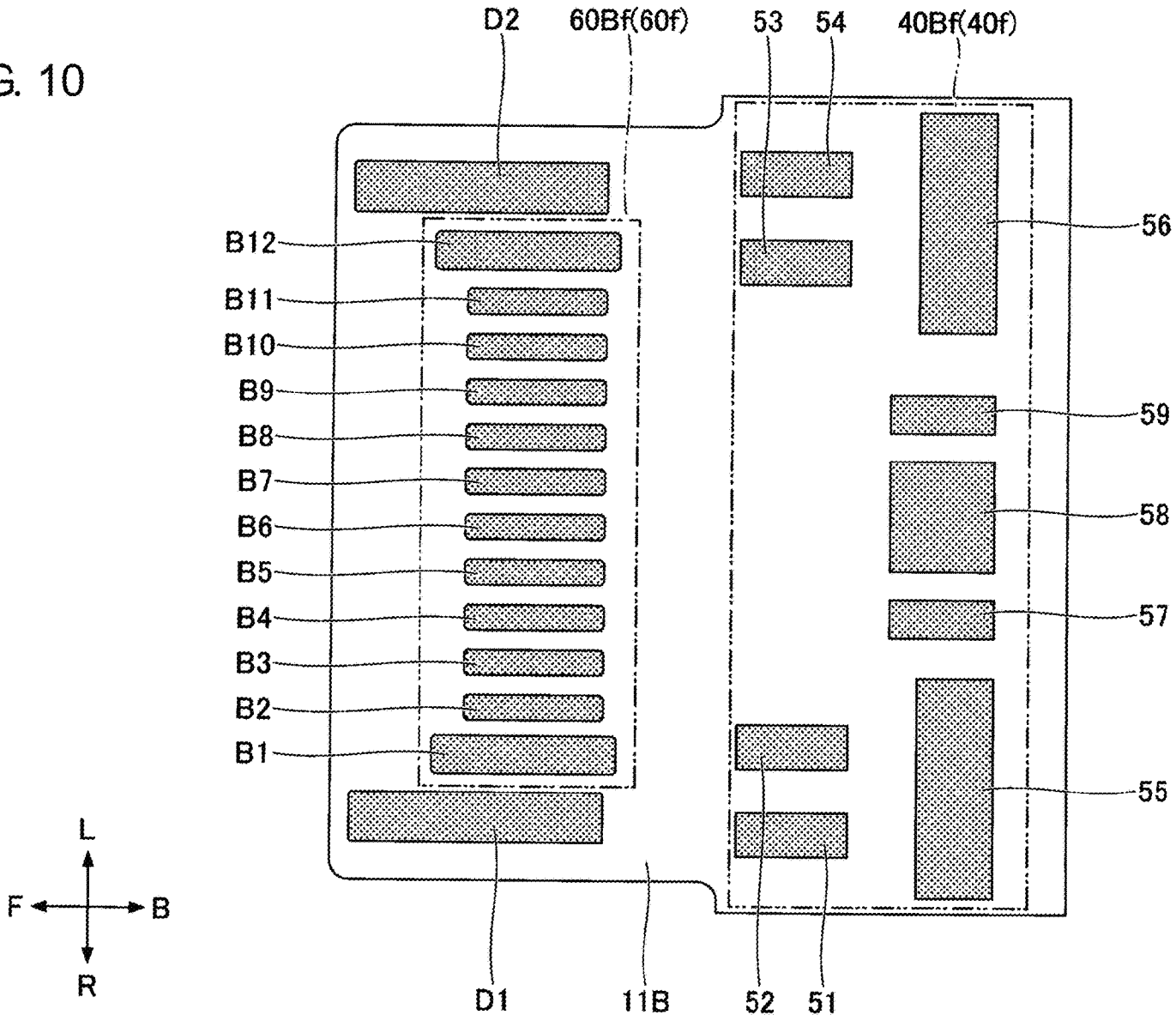
FIG. 10 is a bottom view illustrating the first substrate.

Next, the configuration inside frame 90 is described. First connector 3 includes a first substrate 11 to which multicore cable 2 is connected inside frame 90. FIG. 9 is a top view illustrating the first substrate. FIG. 10 is a bottom view illustrating the first substrate.

First substrate 11 has a first surface 11A and a second surface 11B. In this example, first surface 11A is the upper surface (U side surface) of first substrate 11, and second surface 11B is the lower surface (D side surface) of first substrate 11. First surface 11A faces upper plate 71, and second surface 11B faces lower plate 81. First substrate 11 has a pad group 40*f* and a connector pad group 60*f*. Connector pad group 60*f* is provided on the front F of pad group 40*f*. First substrate 11 includes a wiring layer (not shown) that connects pad group 40*f* and connector pad group 60*f*. Pad group 40*f* and connector pad group 60*f* are provided on first surface 11A and second surface 11B of first substrate 11. For example, the thickness of first substrate 11 is between 0.5 mm and 1.0 mm. First substrate 11 is formed in a substantially flat plate shape. Electronic components such as capacitors and a semiconductor integrated circuit (IC) chips may be mounted on first substrate 11.

Pad group 40*f* includes a first surface-side pad group 40Af provided on first surface 11A and a second surface-side pad group 40Bf provided on second surface 11B. As illustrated in FIG. 9, first surface-side pad group 40Af includes pads 41, 42, 43, 44, 45, 46, 47, 48, 49, and 50. As illustrated in FIG. 10, second surface-side pad group 40Bf includes pads 51, 52, 53, 54, 55, 56, 57, 58, and 59.

As illustrated in FIG. 9, on first surface 11A, pad 46 is provided on the left L of pad 45, and between pad 45 and pad 46, pads 47, 48, 49, and 50 are sequentially provided from the right R to the left L. On first surface 11A, pads 41 and 42 are provided on the front F of pad 45, and pads 43 and 44 are provided on the front F of pad 46. Pad 42 is provided on the left L of pad 41, and pad 44 is provided on the left L of pad 43. Pad 43 is provided on the left L of pad 42.

As illustrated in FIG. 10, on second surface 11B, pad 56 is provided on the left L of pad 55, and between pad 55 and the pad 56, pads 57, 58, and 59 are sequentially provided from the right R to the left L. On second surface 11B, pads 51 and 52 are provided on the front F of pad 55, and pads 53 and 54 are provided on the front F of pad 56. Pad 52 is provided on the left L of pad 51, and pad 54 is provided on the left L of pad 53. Pad 53 is provided on the left L of pad 52.

Connector pad group 60*f* includes a first surface-side connector pad group 60Af provided on first surface 11A and a second surface-side connector pad group 60Bf provided in second surface 11B. As illustrated in FIG. 9, first surface-side connector pad group 60Af includes connector pads A1, A2, A3, A4, A5, A6, A7, A8, A9, A10, A11, and A12. Connector pads A1 to A12 of first surface-side connector pad group 60Af are arranged in a row from the left L to the right R in order on first surface 11A. As illustrated in FIG. 10, second surface-side connector pad group 60Bf includes connector pads B1, B2, B3, B4, B5, B6, B7, B8, B9, B10, B11, and B12. Connector pads B1 to B12 of second surface-side connector pad group 60Bf are arranged in a row from the right R to the left L in order on second surface 11B.

Connector pads A1 and A12 are ground terminals (GND) for grounding. Connector pads A2 and A3 are high-speed signal transmission terminals (TX1+, TX1−). Connector pads A4 and A9 are bus-power-supply terminals (VBUS). Connector pad A5 is a configuration channel terminal (CC). Connector pads A6 and A7 are data-signal terminals (D+, D−). Connector pad A8 is a sideband terminal (SBU1). Connector pads A10 and A11 are high-speed signal reception terminals (RX2+, RX2−).

Connector pads B1 and B12 are ground terminals (GND) for grounding. Connector pads B2 and B3 are high-speed signal transmission terminals (TX2+, TX2−). Connector pads B4 and B9 are bus-power-supply terminals (VBUS). Connector pad B5 is a connected-power-supply terminal (VCONN). Connector pad B8 is a sideband terminal (SBU2). Connector pads B10 and B11 are high-speed signal reception terminals (RX1+, RX1−).

First surface-side pad group 40Af and second surface-side pad group 40Bf are connected to first surface-side connector pad group 60Af and second surface-side connector pad group 60Bf through the wiring layer provided inside first substrate 11. For example, pads 41 to 44 and 51 to 54 are connected to connector pads A2, A3, A10, A11, B2, B3, B10, and B11, which are high-speed signal transmission terminals (TX1+, TX1−) or high-speed signal reception terminals (RX2+, RX20). For example, pad 41 is connected to connector pad A11, pad 42 is connected to connector pad A10, pad 43 is connected to connector pad A3, and pad 44 is connected to connector pad A2. For example, pad 51 is connected to connector pad B2, pad 52 is connected to connector pad B3, pad 53 is connected to connector pad B10, and pad 54 is connected to connector pad B11. Further, for example, pad 45 is connected to connector pad A12, pad 46 is connected to connector pad A1, pad 55 is connected to connector pad B1, and pad 56 is connected to connector pad B12.

In the RL direction, ground pads C1 and C2 for grounding are provided on first surface 11A so as to sandwich first surface-side connector pad group 60Af. Ground pad C1 is provided on the right R of first surface-side connector pad group 60Af, and ground pad C2 is provided on the left L of first surface-side connector pad group 60Af. Ground pad C1 may be connected to connector pad A12, and ground pad C2 may be connected to connector pad A1.

In the RL direction, ground pads D1 and D2 for grounding are provided on second surface 11B so as to sandwich second surface-side connector pad group 60Bf. Ground pad D1 is provided on the right R of second surface-side connector pad group 60Bf, and ground pad D2 is provided on the left L of second surface-side connector pad group 60Bf. Ground pad D1 may be connected to connector pad B1, and ground pad D2 may be connected to connector pad B12.

Figure 11:
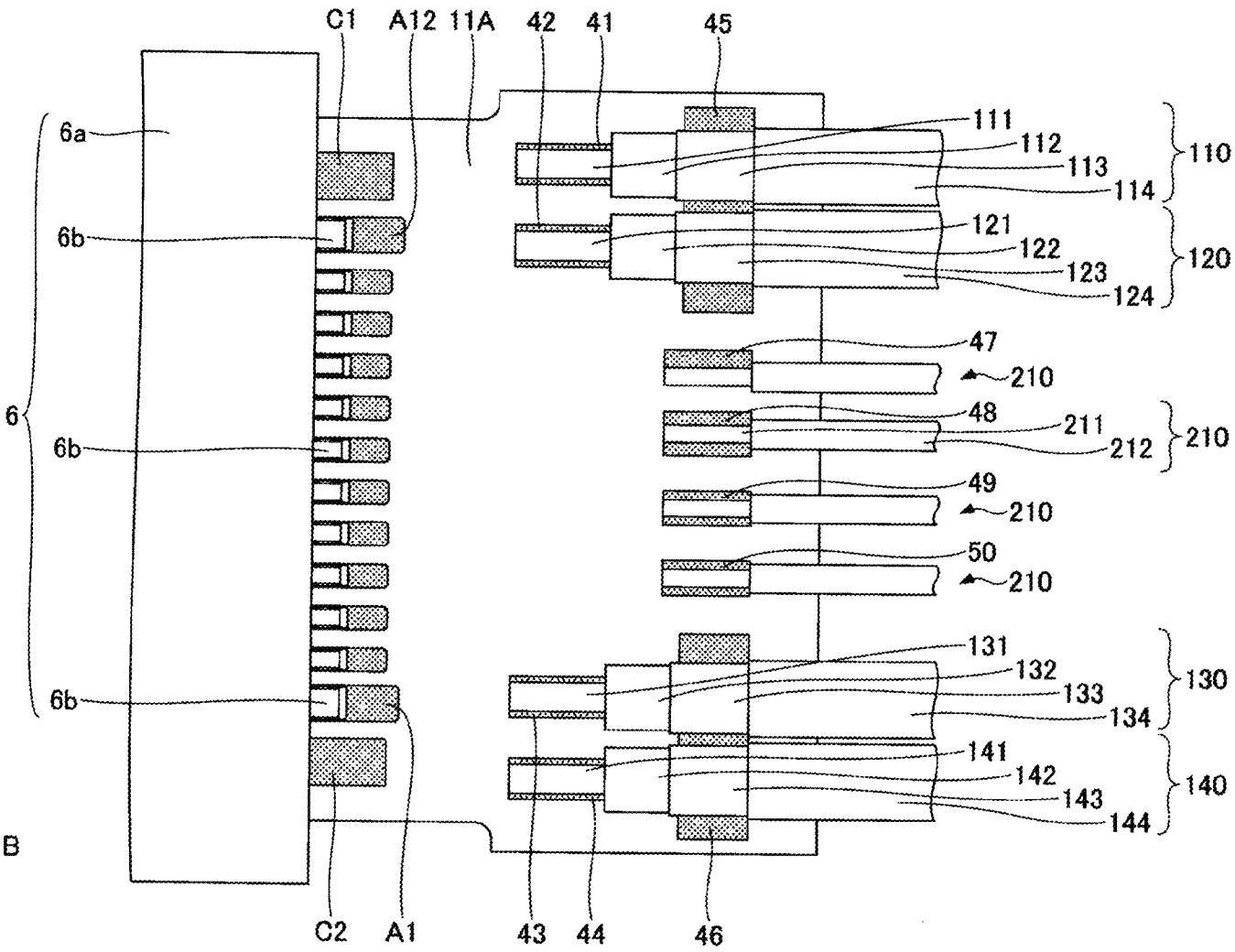
FIG. 11 is a top view illustrating a first substrate, a multicore cable, and a connector plug.
Figure 12:
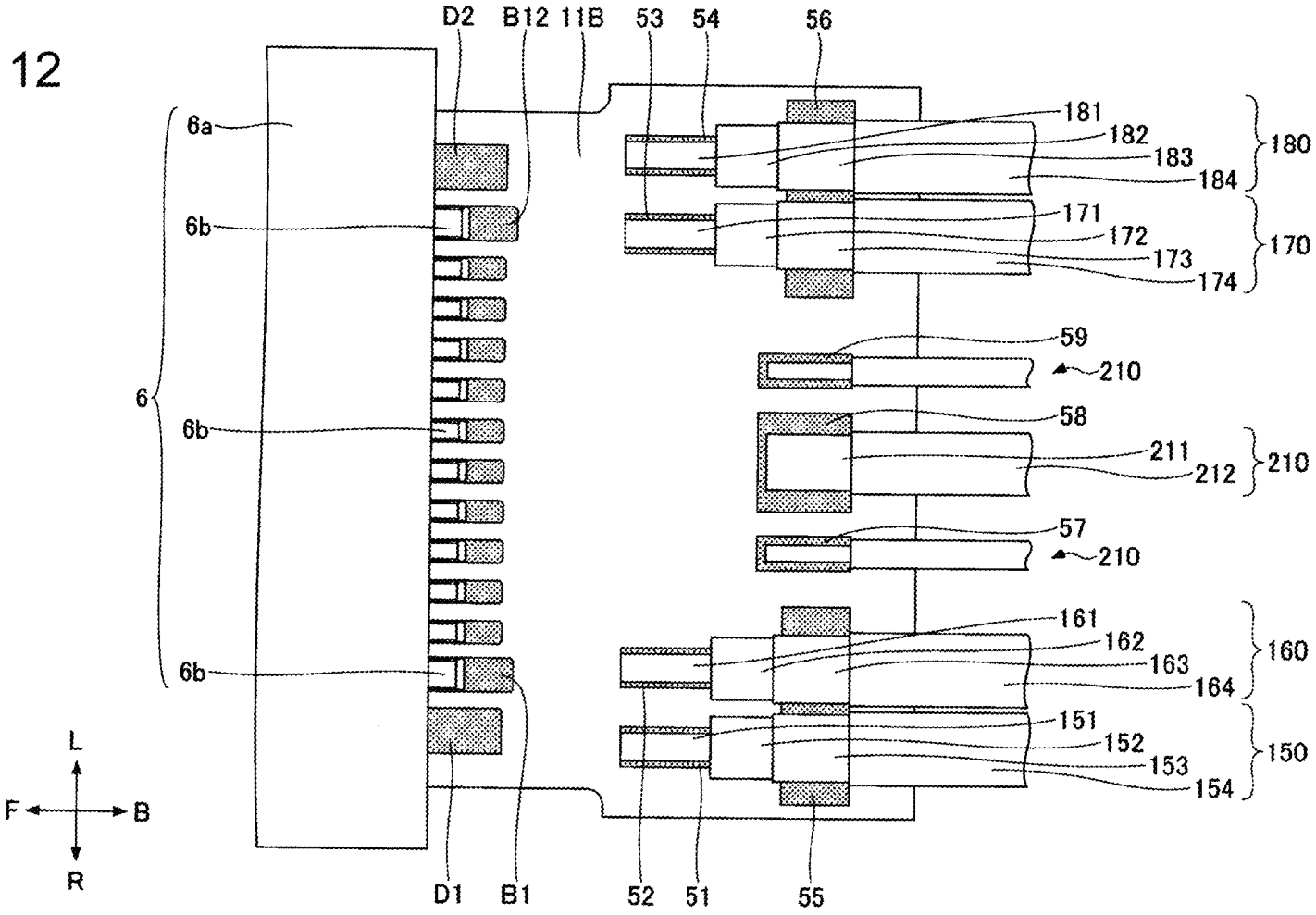
FIG. 12 is a bottom view illustrating a first substrate, a multicore cable, and a connector plug.

Next, the relationship between first substrate 11, multicore cable 2, and connector plug 6 is described. FIG. 11 is a top view illustrating the first substrate, the multicore cable, and the connector plug. FIG. 12 is a bottom view illustrating the first substrate, the multicore cable, and the connector plug.

As illustrated in FIGS. 11 and 12, coaxial electrical wires 110, 120, 130, 140, 150, 160, 170, and 180 included in multicore cable 2 and plurality of (for example, seven) electrical wires 210 are connected to pads 41 to 59 (pad group 40*f*). Further, plurality of (for example, 24) connector pins 6*b* included in connector plug 6 are connected to connector pads A1 to A12 and B1 to B12 (connector pad group 60*f*).

Coaxial electrical wire 110 includes a central conductor 111, an insulating layer 112 provided on the periphery of central conductor 111, an external conductor 113 provided on the periphery of insulating layer 112, and an insulating outer sheath 114 provided on the periphery of external conductor 113. Central conductor 111 is connected to pad 41, and external conductor 113 is connected to pad 45.

Coaxial electrical wire 120 includes a central conductor 121, an insulating layer 122 provided on the periphery of central conductor 121, an external conductor 123 provided on the periphery of insulating layer 122, and an insulating outer sheath 124 provided on the periphery of external conductor 123. Central conductor 121 is connected to pad 42, and external conductor 123 is connected to pad 45.

Coaxial electrical wire 130 includes a central conductor 131, an insulating layer 132 provided on the periphery of central conductor 131, an external conductor 133 provided on the periphery of insulating layer 132, and an insulating outer sheath 134 provided on the periphery of external conductor 133. Central conductor 131 is connected to pad 43, and external conductor 133 is connected to pad 46.

Coaxial electrical wire 140 includes a central conductor 141, an insulating layer 142 provided on the periphery of central conductor 141, an external conductor 143 provided on the periphery of insulating layer 142, and an insulating outer sheath 144 provided on the periphery of external conductor 143. Central conductor 141 is connected to pad 44, and external conductor 143 is connected to pad 46.

Coaxial electrical wire 150 includes a central conductor 151, an insulating layer 152 provided on the periphery of central conductor 151, an external conductor 153 provided on the periphery of insulating layer 152, and an insulating outer sheath 154 provided on the periphery of external conductor 153. Central conductor 151 is connected to pad 51, and external conductor 153 is connected to pad 55.

Coaxial electrical wire 160 includes a central conductor 161, an insulating layer 162 provided on the periphery of central conductor 161, an external conductor 163 provided on the periphery of insulating layer 162, and an insulating outer sheath 164 provided on the periphery of external conductor 163. Central conductor 161 is connected to pad 52, and external conductor 163 is connected to pad 55.

Coaxial electrical wire 170 includes a central conductor 171, an insulating layer 172 provided on the periphery of central conductor 171, an external conductor 173 provided on the periphery of insulating layer 172, and an insulating outer sheath 174 provided on the periphery of external conductor 173. Central conductor 171 is connected to pad 53, and external conductor 173 is connected to pad 56.

Coaxial electrical wire 180 includes a central conductor 181, an insulating layer 182 provided on the periphery of central conductor 181, an external conductor 183 provided on the periphery of insulating layer 182, and an insulating outer sheath 184 provided on the periphery of external conductor 183. Central conductor 181 is connected to pad 54, and external conductor 183 is connected to pad 56.

Coaxial electrical wires 110, 120, 130, and 140 are examples of a first coaxial electrical wire, and external conductors 113, 123, 133, and 143 are examples of a first shield layer. Coaxial electrical wires 150, 160, 170, and 180 are examples of a second coaxial electrical wire, and external conductors 153, 163, 173, and 183 are examples of a first shield layer.

Electrical wires 210 each includes a conductor 211 and an insulating layer 212 provided on the periphery of conductor 211. Conductors 211 of the respective electrical wires 210 are connected to pads 47, 48, 49, 50, 57, 58, and 59.

Each connector pins **6*b* is connected to respective connector pads A1 to A12 and B1 to B12. Further, metal shell 6*a* is in contact with ground pads C1, C2, D1 and D2**.

Figure 13:
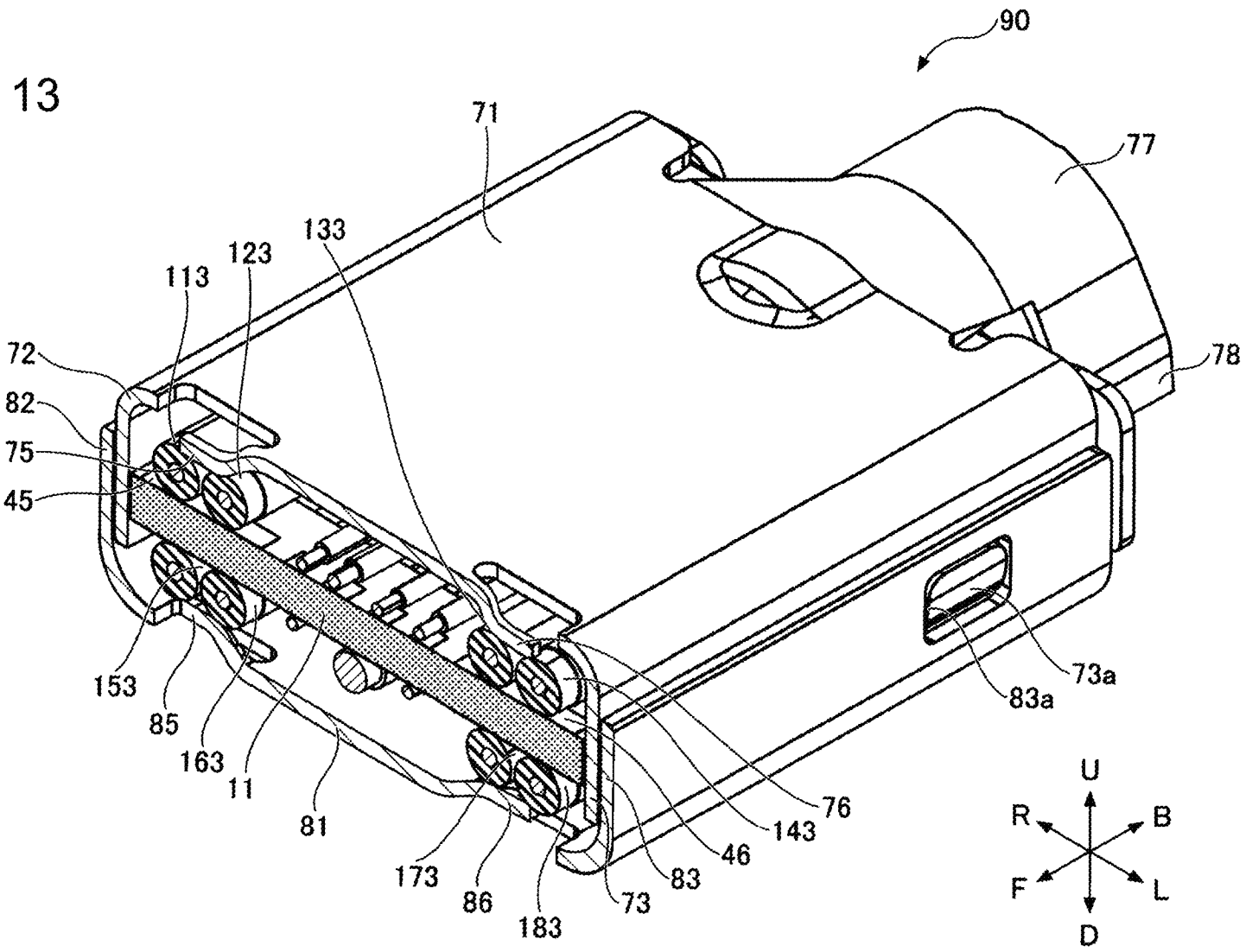
FIG. 13 is a perspective cross-sectional view illustrating the relationship between a metal frame and coaxial electrical wires.

Here, the relationship between a metal frame 90 and coaxial electrical wires 110, 120, 130, 140, 150, 160, 170, and 180 is described. FIG. 13 is a perspective cross-sectional view illustrating the relationship between the metal frame and coaxial electrical wires.

Plate spring 75 is provided on upper frame 70 so as to be positioned at the upper U of pad 45 when frame 90 made of metal is fixed to multicore cable 2. Plate spring 76 is provided on upper frame 70 so as to be positioned at the upper U of pad 46 when frame 90 is fixed to multicore cable 2. Plate spring 85 is provided on lower frame 80 so as to be positioned at the lower D of pad 55 when frame 90 is fixed to multicore cable 2. Plate spring 86 is provided on lower frame 80 so as to be positioned at the lower side D of pad 56 when frame 90 is fixed to multicore cable 2. As described above, external conductor 113 of coaxial electrical wire 110 and external conductor 123 of the coaxial electrical wire 120 are connected to pad 45. External conductor 133 of coaxial electrical wire 130 and external conductor 143 of coaxial electrical wire 140 are connected to pad 46. External conductor 153 of coaxial electrical wire 150 and external conductor 163 of coaxial electrical wire 160 are connected to pad 55. External conductor 173 of coaxial electrical wire 170 and external conductor 183 of coaxial electrical wire 180 are connected to pad 56.

Plate spring 75 contacts external conductors 113 and 123 and presses coaxial electrical wires 110 and 120 against first substrate 11. Plate spring 76 contacts external conductors 133 and 143 and presses coaxial electrical wires 130 and 140 against first substrate 11. Plate spring 85 contacts external conductors 153 and 163 and presses coaxial electrical wires 150 and 160 against first substrate 11. Plate spring 86 contacts external conductors 173 and 183 and presses coaxial electrical wires 170 and 180 against first substrate 11. In other words, plate spring 75 is connected to external conductors 113 and 123, plate spring 76 is connected to external conductors 133 and 143, plate spring 85 is connected to external conductors 153 and 163, and plate spring 86 is connected to external conductors 173 and 183.

In the embodiment of the present disclosure, a metallic upper frame 70 is soldered to metal shell **6*a*. Plate spring 75 provided on upper frame 70 is connected to external conductors 113 and 123, and plate spring 76 is connected to external conductors 133 and 143. That is, external conductors 113, 123, 133, and 143 are electrically connected to metal shell 6*a*. External conductors 113 and 123 are supplied with the ground potential through connector pad A12 and the wiring layer of first substrate 11. External conductors 133 and 143 are supplied with the ground potential through connector pad A1 and the wiring layer of first substrate 11. Further, external conductors 113, 123, 133, and 143 are also supplied with the ground potential through metal shell 6*a*. Therefore, noise of signals transmitted through coaxial electrical wires 110, 120, 130, and 140** can be reduced and reliability can be improved.

Similarly, lower frame 80 that is made of metal is soldered to metal shell **6*a*. Plate spring 85 provided on lower frame 80 is connected to external conductors 153 and 163, and plate spring 86 is connected to external conductors 173 and 183. That is, external conductors 153, 163, 173, and 183 are electrically connected to metal shell 6*a*. External conductors 153 and 163 are supplied with the ground potential through connector pad B1 and the wiring layer of first substrate 11. External conductors 173 and 183 are supplied with the ground potential through connector pad B12 and the wiring layer of first substrate 11. Further, external conductors 153, 163, 173, and 183 are also supplied with the ground potential through metal shell 6*a*. Therefore, noise of signals transmitted through coaxial electrical wires 150, 160, 170, and 180** can be reduced and reliability can be improved.

Since upper frame 70 is used for electrical connection between external conductors 113, 123, 133, and 143 and metal shell **6*a*, and lower frame 80 is used for electrical connection between external conductors 153, 163, 173, and 183 and metal shell 6*a***, assembly can be easily performed.

In the embodiment of the present disclosure, since upper frame 70 is connected to shield layer 22 of multicore cable 2 through claw portions 78, external conductors 113, 123, 133, and 143 are also electrically connected to shield layer 22. Therefore, noise of signals transmitted through coaxial electrical wires 110, 120, 130, and 140 can be further reduced, and reliability can be further improved. Further, upper frame 70 and lower frame 80 are connected to each other by fitting protrusion **72*a* into opening 82*a* and fitting protrusion 73*a* into opening 83*a*. Thus, external conductors 153, 163, 173, and 183 are also electrically connected to shield layer 22. Therefore, noise of signals transmitted through coaxial electrical wires 150, 160, 170, and 180** can be further reduced, and reliability can be further improved.

Since plate spring 75 presses coaxial electrical wires 110 and 120 against first substrate 11, coaxial electrical wires 110 and 120 are less likely to be displaced on first substrate 11, and excellent connection reliability is obtained between external conductors 113 and 123 and pad 45. Further, the electrical connection between plate spring 75 and external conductors 113 and 123 can be maintained for a long period of time without soldering. If soldering is performed for connection between plate spring 75 and external conductors 113 and 123 after external conductors 113 and 123 are soldered to pad 45, external conductors 113 and 123 may be separated from pad 45. By omitting soldering for connection between plate spring 75 and external conductors 113 and 123, detachment of external conductors 113 and 123 from pad 45 can be suppressed. The same applies to plate springs 76, 85 and 86.

In addition, a downward D force acts on first substrate 11 from plate springs 75 and 76 through coaxial electrical wires 110, 120, 130, and 140, and an upward U force acts on first substrate 11 from plate springs 85 and 86 through coaxial electrical wires 150, 160, 170, and 180. Therefore, the position of first substrate 11 in the UD direction is stabilized at the position where the spring forces of plate springs 75 and 76 and the spring forces of plate springs 85 and 86 are balanced. For example, if the spring forces of plate springs 75 and 76 are equal to the spring forces of plate springs 85 and 86, the position of first substrate 11 in the UD direction is stable near the center of frame 90.

Plate springs 75, 76, 85 and 86 can be easily formed by punching and bending metal plates. Therefore, it is easy to manufacture upper frame 70 and lower frame 80.

In addition, since one end of multicore cable 2 is inserted into boot 100 and the portion of metal shell 6*a* is exposed from boot 100, metal shell 6*a* can be connected to the receptacle of the electronic device and the inner portion of boot 100 of multicore cable 2 can be insulated from the outside.

Although the embodiments have been described in detail, the present invention is not limited to the specific embodiments, and various modifications and changes can be made within the scope of the claims.

REFERENCE SIGNS LIST

1: connector-equipped multicore cable
2: multicore cable
3: first connector
4: second connector
6: connector plug
6*a*: metal shell
6*b*: connector pin
11: first substrate
11A: first surface
11B: second surface
21: insulating layer
22: shield layer
23: outer sheath
31: first end portion
32: second end portion
40Af: first surface-side pad group
40Bf: second surface-side pad group
40*f*: pad group
41, 42, 43, 44, 45, 46, 47, 48, 49, 50, 51, 52, 53, 54, 55, 56, 57, 58, 59: pad
60Af: first surface-side connector pad group
60Bf: second surface-side connector pad group
60*f*: connector pad group
70: upper frame
71: upper plate
72: side plate
72*a*: protrusion
73: side plate
73*a*: protrusion
74: coupling portion
74*b*: opening
77: fixing portion
78: claw portion
80: lower frame
81: lower plate
82: side plate
82*a*: opening
83: side plate
83*a*: opening
84: coupling portion
84*b*: opening
87: fixing portion
90: frame
100: boot
110, 120, 130, 140, 150, 160, 170, 180: coaxial electrical wire
111, 121, 131, 141, 151, 161, 171, 181: central conductor
112, 122, 132, 142, 152, 162, 172, 182: insulating layer
113, 123, 133, 143, 153, 163, 173, 183: external conductor
114, 124, 134, 144, 154, 164, 174, 184: outer sheath
200: strain relief
210: electrical wire
211: conductor
212: insulating layer
A1, A2, A3, A4, A5, A6, A7, A8, A9, A10, A12, B1, B2, B3, B4, B5, B6, B7, B8, B9, B10, B11, B12: connector pad
C1, C2, D1, D2: ground pad

The invention claimed is:

1. A connector-equipped multicore cable comprising:
a connector including a first end portion and a second end portion; and
a multicore cable including a plurality of coaxial electrical wires and connected to the first end portion,
wherein the connector includes, at the second end portion, a cover that is made of a metal and that covers a connector terminal,
wherein the plurality of coaxial electrical wires each include a first shield layer, and
wherein the first shield layer and the cover are electrically connected to each other,
wherein the connector includes
a substrate having a first surface to which a first coaxial electrical wire included in the plurality of coaxial electrical wires is connected, and
a first metal plate that covers the first surface to which the first coaxial electrical wire is connected and that is connected to the cover and the first shield layer of the first coaxial electrical wire,
wherein the multicore cable includes a second shield layer that covers the plurality of coaxial electrical wires, and
wherein the first metal plate is connected to the second shield layer.

2. The connector-equipped multicore cable according to claim 1,
wherein the first metal plate includes
a first body portion, and a first elastic member extending from the first body portion and connected to the first shield layer of the first coaxial electrical wire.

3. The connector-equipped multicore cable according to claim 2, wherein the first elastic member presses the first coaxial electrical wire against the substrate.

4. The connector-equipped multicore cable according to claim 2, wherein the first elastic member is a first plate spring.

5. The connector-equipped multicore cable according to claim 1, wherein the substrate has a second surface to which a second coaxial electrical wire included in the plurality of coaxial electrical wires is connected, the second surface being opposite to the first surface, wherein the connector includes a second metal plate that covers the second surface to which the second coaxial electrical wire is connected and that is connected to the cover and the first shield layer of the second coaxial electrical wire, and wherein the second metal plate includes a second body portion, and a second elastic member extending from the second body portion and connected to the first shield layer of the second coaxial electrical wire.

6. The connector-equipped multicore cable according to claim 5, wherein the second elastic member presses the second coaxial electric wire against the substrate.

7. The connector-equipped multicore cable according to claim 5, wherein the second elastic member is a second plate spring.

8. The connector-equipped multicore cable according to claim 5, wherein the first metal plate and the second metal plate are coupled to each other.

* * * * *